United States Patent [19]

Spence

[11] 4,082,359

[45] Apr. 4, 1978

[54] METHOD FOR THE RECOVERY OF A MATERIAL

[75] Inventor: Andrew P. Spence, Plano, Tex.

[73] Assignees: Atlantic Richfield Company, Los Angeles, Calif.; NM Uranium, Inc., Houston, Tex.; United States Steel Corporation, Pittsburgh, Pa.

[21] Appl. No.: 715,342

[22] Filed: Aug. 17, 1976

[51] Int. Cl.[2] ..... E21B 43/28; E21C 41/14

[52] U.S. Cl. ..... 299/4; 166/263

[58] Field of Search ..... 299/4, 5; 166/259, 263

[56] References Cited

U.S. PATENT DOCUMENTS

| | | | |
|---|---|---|---|
| 3,734,180 | 5/1973 | Rhoades | 166/259 |
| 3,881,774 | 5/1975 | Van Poolen | 299/4 |

*Primary Examiner*—Ernest R. Purser

*Attorney, Agent, or Firm*—Ronnie D. Wilson

[57] ABSTRACT

The present invention relates to an improved method for the solution mining of a mineral from a subterranean formation. More specifically, the invention relates to an improved method which enhances significantly the recovery of the mineral from a subterranean formation via solution mining. The improvement comprises switching a well which initially functions as a producer to an injector and vice versa after oxidant breakthrough has occurred at a production well.

8 Claims, No Drawings

METHOD FOR THE RECOVERY OF A MATERIAL

Generally, known methods for solution mining of mineral in situ utilize an acid or alkaline leach solution for the dissolution of the mineral. An oxidant is injected into the formation along with the leach solution. The mineral is leached from the formation and recovered from a production well via a pregnant leach solution. Various procedures for recovering the mineral from the pregnant leach solution are well known, such as ion exchange.

The process of the present invention is particularly suitable for the leaching of uranium; however, my invention is not so limited. The following description of the present invention will be in regard to uranium leaching; however, it is apparent that it is applicable to leaching other mineral values such as copper, nickel, molybdenum, rhenium and selenium where similar problems are encountered.

Although acid leaching solutions can be used in some uranium containing formations, only alkaline leaching solutions can be used where the particular formation contains significant quantities of acid-consuming gangue.

It is well-known that to increase the recovery of uranium from an underground ore body, it is necessary to convert the relatively insoluble tetravalent state of uranium in the ore to the solubilizable hexavalent state. When using an alkaline leach solution, the dissolution of the uranium in solution occurs in two steps. The first step involves the oxidation of uranium and the second the dissolution of the oxidized uranium in the solution.

It has been found that during the early stages (when the ore body is in a reduced state) of a leach operation utilizing alkaline solutions of ammonium carbonate, sodium carbonate and potassium carbonate and their respective bicarbonatesin conjunction with the typical oxidants of air, oxygen, and hydrogen peroxide, the uranium that is oxidized and dissolved near the injection well is reduced and precipitated in the more reduced regions of the formation between the injection well and the production well. Through this action the oxidized region of the formation is depleted of uranium and the reduced region of the formation becomes enriched as the leach operation continues. Therefore, this process of oxidation and dissolution followed by reduction and precipitation continues as the formation becomes progressively oxidized, whereby the region in the immediate vicinity of the production well becomes progressively enriched. The uranium is depleted from a zone in the formation far more quickly than the oxidant consuming gangue species present therein. Therefore, as the uranium oxidation front recedes from the injection well, the available oxidant for oxidation of the uranium decreases. This causes a slower dissolution of uranium and a lower maximum concentration of uranium in solution as the depleted zone moves through the formation. Therefore, there is needed a method whereby a formation containing a mineral such as uranium can be leached with a solution without being accompanied by excessive losses of oxidant and a diminishing rate of mineral recovery.

Therefore, it is an object of the present invention to provide an improved method for the solution mining of a mineral from a subterranean formation, applicable generally to minerals requiring oxidation to be leached and to both acid and alkaline leach solutions.

A further object of the present invention is to provide an improved method for the solution mining of uranium.

It is an additional objective of the present invention to provide an improved method for the solution mining of uranium from subterranean deposits which substantially maintains its initial rate of recovery in the later stages of the operation without the needless waste of oxidant.

Other objects, aspects, and the several advantages of the present invention will become apparent upon a further reading of this disclosure and the appended claims.

It has now been found that the objects of the present invention can be attained in a method for the solution mining of a mineral from a subterranean formation containing same in which an injection and production well are drilled and completed within said formation, a leach solution and an oxidant are injected through the injection well into the formation to dissolve the mineral and recover it via a production well, by switching the functions of said wells after oxidant breakthrough at the production well, whereby the production well is utilized to inject the solution and oxidant and the injection well is utilized to recover the dissolved mineral.

In the operation of the improved method to recover uranium, the switching of the functions of the wells requires the physical changing of the equipment necessary to change a well from a producer to an injector and vice versa. By switching the functions of the wells, after oxidant breakthrough uranium which has been precipitated near the well which initially was a producer is oxidized by the new injections and furthermore will not reprecipitate as it did under initial conditions because the reducing conditions have been substantially eliminated downstream of its dissolution. Therefore, the uranium wll be produced at a higher concentration than previously attainable if no switch occurred.

It is important that the switching of the wells from producer to injector and vice versa take place only after oxidant breakthrough at the production well in order to most efficiently utilize the present invention. Without switching of the wells after oxidant breakthrough, the injected leach solution and oxidant have only gangue with which to react. The gangue reacts with the oxidant significantly reducing its concentration before the injected solution reaches the uranium downstream near the production well. Thus, only a small amount of oxygen remains available for uranium dissolution.

The necessary determination of oxidant breakthrough can be observed at the production well by measuring the amount of oxidant present in the produced pregnant solution. When the oxidant concentration of the produced pregnant solution becomes greater than five parts per million, oxidant breakthrough has occurred and the switch may be made. Preferably, the switch should be made when the oxidant concentration of the produced pregnant solution is within the range of from about 15 to about 25 parts per million. This determination can be made by using conventional means such as the Winkler Method. Ideally, oxidant breakthrough occurs when any oxidant is present in the produced pregnant solution. However, since routine industrial analytical and sampling methods are not ideal, it is unlikely that oxidant concentrations of less than five ppm can be measured by such routine methods. Therefore, the above-indicated figure of five parts per million for oxidant breakthrough takes into account the imperfections of routine methods of analysis and sampling.

More exacting measurements of oxidant concentrations of less than five ppm can be made with expensive equipment and elaborate sampling techniques, but it is not necessary in the practice of the present invention.

Therefore, through the utilization of the present invention, the recovery of uranium via in situ leaching processes, can be enhanced significantly by most effectively using the available oxygen to oxidize uranium rather than gangue.

Having thus described the invention, I claim:

1. An improved method for the solution mining of a mineral from a subterranean formation containing same in which an injection and production well are drilled and completed within said formation, leach solution and an oxidant are injected through said injection well into said formation to dissolve said mineral, and said dissolved mineral is recovered via said production well, wherein the improvement comprises switching the functions of said wells when the oxidant concentration of the produced solution at said production well becomes greater than five parts per million, whereby said production well is utilized to inject said solution and oxidant and said injection well is utilized to recover said dissolved mineral.

2. The improvement of claim 1 wherein said oxidant concentration is from about 15 to about 25 parts per million.

3. The improvement of claim 1 wherein said mineral is selected from the group consisting of copper, nickel, molybdenum, rhenium, selenium and uranium.

4. The improvement of claim 1 wherein said leach solution is acidic in nature.

5. The improvement of claim 4 wherein said acid leach solution is selected from the group consisting of hydrochloric and sulfuric acid.

6. The improvement of claim 1 wherein said leach solution is alkaline in nature.

7. The improvement of claim 6 wherein said alkaline leach solution is an aqueous solution of one or more salts selected from the group consisting of ammonium carbonate, sodium carbonate, potassium carbonate and their respective bicarbonates.

8. The improvement of claim 1 wherein said oxidant is selected from the group consisting of air, oxygen and hydrogen peroxide.

* * * * *

UNITED STATES PATENT OFFICE

CERTIFICATE OF CORRECTION

PATENT NO. : 4,082,359

DATED : April 4, 1978

INVENTOR(S) : Andrew P. Spence

It is certified that error appears in the above-identified patent and that said Letters Patent are hereby corrected as shown below:

In the title, line 2, "MATERIAL" should read --MINERAL--.

Column 1, line 1, "MATERIAL" should read --MINERAL--.

Signed and Sealed this

*Twenty-fifth* Day of *July 1978*

[SEAL]

*Attest:*

RUTH C. MASON
*Attesting Officer*

DONALD W. BANNER
*Commissioner of Patents and Trademarks*